United States Patent [19]

Leonard et al.

[11] 4,063,509

[45] Dec. 20, 1977

[54] DEVICE FOR STIMULATION OF GEOTHERMAL WELLS

[75] Inventors: Guy W. Leonard, China Lake; Carl F. Austin, Inyokern, both of Calif.

[73] Assignee: The United States of America as represented by the Secretary of the Navy, Washington, D.C.

[21] Appl. No.: 686,768

[22] Filed: May 17, 1976

[51] Int. Cl.[2] ..... E21B 43/26

[52] U.S. Cl. ..... 102/20; 102/21; 166/63; 175/4.59

[58] Field of Search ..... 102/20, 21, 21.6, 24 HC; 166/299, 297, 63; 175/4.54, 4.59, 4.6

[56] References Cited

U.S. PATENT DOCUMENTS

| | | | |
|---|---|---|---|
| 2,029,478 | 2/1936 | Haines | 175/4.59 X |
| 2,873,675 | 2/1959 | Lebourg | 102/24 HC |
| 2,915,124 | 12/1959 | Chesnut | 166/63 |
| 3,128,702 | 4/1964 | Christopher | 102/24 HC |
| 3,415,321 | 12/1968 | Venghiattis | 102/24 HC X |
| 3,422,760 | 1/1969 | Mohaupt | 102/21.6 |
| 3,433,305 | 3/1969 | Bell | 166/297 |
| 3,739,723 | 6/1973 | Hakala | 102/20 |
| 3,856,094 | 12/1974 | Davis | 175/4.59 X |
| 3,939,927 | 2/1976 | Bohn | 175/4.59 X |

OTHER PUBLICATIONS

The Condensed Chemical Dictionary, 8th Ed., Van Nostrand Reinhold Company, p. 794.

*Primary Examiner*—David H. Brown

*Attorney, Agent, or Firm*—R. S. Sciascia; Roy Miller; L. E. K. Pohl

[57] ABSTRACT

A device comprising an outer shell, open at one end, a charge carrier for carrying shaped charges suspended within the outer shell and means for releasing gas suspended within the outer shell used in the stimulation of geothermal wells.

4 Claims, 2 Drawing Figures

DEVICE FOR STIMULATION OF GEOTHERMAL WELLS

BACKGROUND OF THE INVENTION

1. Field of the Invention.

This invention relates to devices for the stimulation of geothermal wells.

2. Description of the Prior Art.

Just as there are more dry holes drilled for oil, gas, and now for geothermal fluids than there are successful ones, so also there are more marginal and sub-marginal producers drilled than there are initially producers. Thus, the developer of a geothermal field, unless blessed with extreme luck, will quickly find himself faced with "almost" commercial wells. His problem is then how to increase the production of wells that have failed to produce in commercial quantities. Also, he is faced with the corollary problem of how to stimulate already commercial wells in order to achieve greater production from them to make up for losses accrued from the drilling of non-commercial wells.

Geothermal wells may be stimulated by means of explosives. More specifically, geothermal wells may be stimulated by means of shaped charges which blast pencil-shaped jets of liner material into rock strata crushing and penetrating the rock, cement and tubing and allowing geothermal fluids to seep through from the perforated materials into the main bore-hole of the well. However, when one wishes to utilize shaped charges to stimulate the production of geothermal wells one is faced with two problems — temperature and fluids under pressure.

The temperature near the bottom of a geothermal well where one normally wishes to blast is ordinarily extremely high. When a shaped charge is lowered into this high temperature a problem of preventing what is commonly called "cook-off" of the explosive arises.

The pressure of geothermal fluids in the depths of a geothermal well is ordinarily high. Shaped charges generally utilize cone-shaped liners which collapse when the explosive is detonated and focus the pencil-shaped jets spoken of above. When such a cone is filled with high-pressure geothermal fluid, the fluid interfers with the proper collapse of the cone and the jet does not get properly formed.

SUMMARY OF THE INVENTION

It has now been found that a gas releasing means such as a gas generator cartridge which reacts with geothermal fluid or a pyrotechnic cartridge may be utilized to combat the problems of temperature and fluid interference in geothermal well stimulation. According to this invention, the gas releasing means is utilized to pressurize a housing in which one or more shaped charges are suspended and keep geothermal fluid out as the housing and shaped charges are lowered into a well. The exclusion of geothermal fluid from the housing prevents the fluid from interfering with the proper collapse of shaped charge conical liners, i.e., interfering with jet formation, and also prevents geothermal fluid from being in near proximity to shaped charges where it can deleteriously affect the shaped charge performance temperature wise, i.e., by causing "cook-off."

DESCRIPTION OF THE PREFERRED EMBODIMENTS

Figure 1:
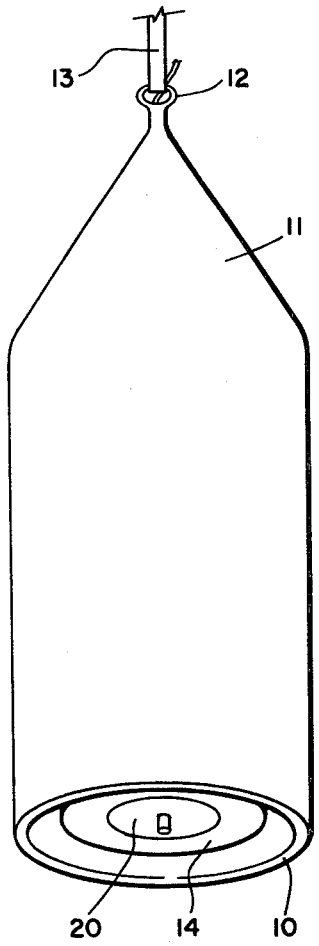
FIG. 1 is a perspective view of a device according to this invention.

The present invention may be readily understood by referring to the drawing.

FIG. 1 is a perspective view of a device according to the invention. The device has an outer shell 10 having an open bottom end and an ogive shaped top end 11. The top end is air tight. The device has, attached to or integrally formed with the top end attachment means 12 to which a line 13 can be affixed to lower the device into a well. Suspended within the outer shell is a charge carrier 14 which, in addition to carrying explosive charges (not shown in FIG. 1) has mounted in it a gas releasing means 20.

Figure 2:
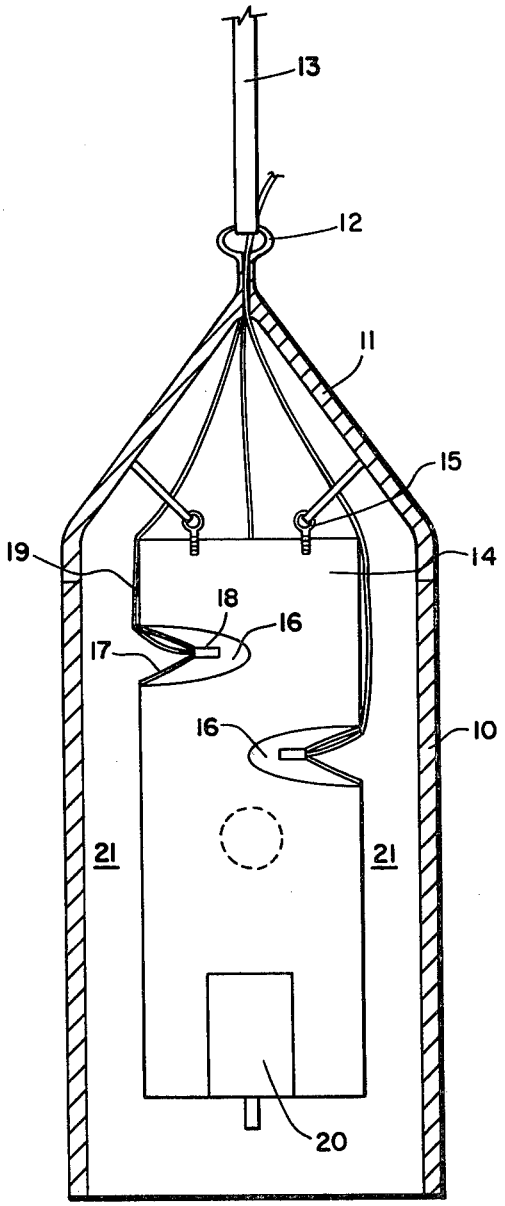
FIG. 2 is a longitudinal cross-sectional view of the device of FIG. 1.

FIG. 2 shows the device of FIG. 1 in cross-section. As can be seen from FIG. 2, the charge carrier 14 may be suspended by a ring and line arrangement 15 and is a solid piece of material such as solid plastic having depressions (which may be machined or molded) for holding shaped charges 16. The shaped charges have conical liners 17 which, when the charges are detonated, are collapsed to focus the liner material 17 into a penetrating jet. Detonators 18 are shown inserted into the shaped charges and electric detonator wires 19 are shown leading from the detonators. The wires 19 are shown passing through the ogive shaped top of the device and, like the lowering line 13, lead to the surface.

As can be seen from FIG. 2, the device contains open space 21 between the inner wall of the outer shell and the charge carrier. This invention is primarily concerned with this space. More particularly, this invention is primarily concerned with keeping geothermal fluids out of space 21 as the device is lowered into a geothermal well.

To keep geothermal fluids out of space 21 as the device is lowered into a well, gas releasing means 20 is utilized. Gas releasing means 20 may be a pyrotechnic cartridge or a gas generator cartridge that reacts with the well fluids. The gas generating means is utilized to produce gas which fills space 21 producing a "diving bell" effect and prevents geothermal fluid from filling space 21 as the device is lowered into the well. One example, although not be any means the only one, of a pyrotechnic cartridge is a cartridge based on sodium azide. One example of a material that will react with a geothermal fluid to produce gas is sodium. Both pyrotechnic cartridges and gas generator materials that will react with geothermal fluids are known.

By preventing geothermal fluid from filling space 21, two important effects are achieved. The gas that fills space 21 is a poor heat transfer medium and acts as an insulator. This allows one to use any readily available and well known explosive to form the shaped charges 16 without concern with whether or not temperature effects will cause the explosive to cook off prematurely. Secondly, since geothermal fluid cannot fill cones 17, geothermal fluid cannot interfere with the proper collapse of cones 17 when the explosive charges are detonated.

In the practice of this invention, it is required that all parts with the exception of cones 17 be fabricated from frangible material. Since the pressure exerted from within by the gas from the gas generating means equalized with the pressure exerted from without by the geothermal fluid, any frangible material such as plastic, a ceramic or a metal that will break up into very small pieces is suitable. That is, there are no unequal pressures to put strain on the shell and cause it to burst or collapse.

The reason that it is required to fabricate the shell as well as all other parts (except the cones 17) of the device from frangible material may be quickly realized by imagining what happens when shaped charges 16 are detonated. When the shaped charges are detonated, cones 17 collapse and pencil-shaped jets shoot out perpendicularly to the longitudinal direction of the well bore hole. If the shell and the other parts of the device were fabricated from a tough non-frangible material, the material would prove highly deleterious because the jets would expend their power penetrating it and the remaining parts would then constitute highly deleterious "junk" in the well. That is, the shaped charge, when it was detonated, would break up the shell and other parts of the device and if the material were not frangible, i.e., did not break into very small pieces, large, irregular sized pieces of "junk" would be deposited in the well.

In another embodiment, the gas releasing means may be used as a fluid sensing device. The fluid sensing device may be located at any point within the outer shell above which it is undesirable to have geothermal fluid and used in any known manner to activate the gas releasing means if fluid reaches this point. This may be achieved by using a gas generating cartridge that reacts chemically with the well fluid to produce the needed high pressure gases while the device is being lowered into the well.

The drawing shows the gas releasing means located at the base or bottom of the charge carrier. It need not be located at that particular position. It may be located at any convenient place within the shell.

What is claimed is:

1. In a method for stimulating a geothermal well wherein a shaped charge is lowered into the well and detonated, the improvement residing in utilizing a gas releasing means to prevent geothermal fluid from coming into near proximity of said shaped charge, said gas releasing means being selected from the group consisting of pyrotechnic cartridges and gas generating cartridges which react with geothermal fluids, and said gas releasing means being adapted to produce gas without activating said shaped charge.

2. In a method according to claim 1 the improvement residing in utilizing as said gas releasing means a pyrotechnic cartridge based on sodium azide.

3. In a method according to claim 1, the improvement residing in utilizing as said gas releasing means is a gas generating cartridge based on sodium.

4. A device for stimulating the production of a geothermal well comprising:

a frangible housing which is open at one end and closed at the other;

a frangible charge carrier suspended in said housing and carrying one or more shaped charges; and a gas releasing means mounted within said housing, said gas releasing means being capable of producing enough gas to prevent geothermal fluids from coming into contact with said shaped charges and said gas releasing means being of a type such that when it is activated it will not activate said shaped charges.

* * * * *